US008622246B2

(12) United States Patent
Mehus et al.

(10) Patent No.: US 8,622,246 B2
(45) Date of Patent: Jan. 7, 2014

(54) FLUID RESERVOIR DOCKING STATION

(75) Inventors: Richard Jondall Mehus, Richfield, MN (US); David Falbaum, Minneapolis, MN (US); Brandon Schirmer, Rosemount, MN (US)

(73) Assignee: Ecolab USA Inc., St. Paul, MN (US)

( * ) Notice: Subject to any disclaimer, the term of this patent is extended or adjusted under 35 U.S.C. 154(b) by 0 days.

(21) Appl. No.: 13/372,130

(22) Filed: Feb. 13, 2012

(65) Prior Publication Data

US 2013/0206280 A1 Aug. 15, 2013

(51) Int. Cl.
*B65D 35/56* (2006.01)

(52) U.S. Cl.
USPC ..... 222/105; 222/333

(58) Field of Classification Search
USPC ..... 222/105, 92–94, 66, 181.1–181.6, 333, 222/173, 626, 153.01, 153.09–153.12
See application file for complete search history.

(56) References Cited

U.S. PATENT DOCUMENTS

| | | | | |
|---|---|---|---|---|
| 4,634,818 | A | 1/1987 | Hayes-Pankhurst | |
| 5,156,301 | A | 10/1992 | Hassell et al. | |
| D340,133 | S | 10/1993 | Hayes-Pankhurst | |
| 5,708,877 | A | 1/1998 | Pankhurst | |
| 5,715,491 | A | 2/1998 | Pankhurst | |
| D399,518 | S | 10/1998 | Hayes-Pankhurst | |
| D400,551 | S | 11/1998 | Pankhurst | |
| 5,836,482 | A * | 11/1998 | Ophardt et al. | 222/325 |
| 6,561,386 | B1 * | 5/2003 | Martens | 222/105 |
| 6,688,499 | B2 * | 2/2004 | Zhang | 222/413 |
| 7,621,511 | B2 | 11/2009 | Hayes-Pankhurst | |
| 7,674,100 | B2 | 3/2010 | Hayes-Pankhurst | |
| 8,261,942 | B2 * | 9/2012 | Chen | 222/63 |
| 8,261,950 | B2 * | 9/2012 | Cittadino et al. | 222/321.7 |
| 2001/0010316 | A1 | 8/2001 | Parsons et al. | |
| 2002/0179643 | A1 | 12/2002 | Knight | |
| 2004/0144799 | A1 | 7/2004 | Danby | |
| 2006/0278657 | A1 * | 12/2006 | Roatis | 222/129.1 |
| 2008/0283556 | A1 * | 11/2008 | Snodgrass | 222/325 |
| 2009/0107166 | A1 | 4/2009 | Sowers et al. | |
| 2009/0145926 | A1 | 6/2009 | Klopfenstein et al. | |

FOREIGN PATENT DOCUMENTS

| | | |
|---|---|---|
| EP | 0203068 | 8/1992 |
| EP | 0629562 | 12/1994 |
| EP | 0629563 | 12/1994 |

(Continued)

OTHER PUBLICATIONS

Notification of Transmittal of the International Search Report and the Written Opinion of the International Searching Authority, or the Declaration of corresponding application PCT/US2013/025739, mailed Jul. 18, 2013, 12 pages.

*Primary Examiner* — Lien Ngo
(74) *Attorney, Agent, or Firm* — Fredrikson & Byron, P.A.

(57) ABSTRACT

A fluid dispensing system may include a fluid outlet connected to a flexible fluid reservoir and a docking station configured to receive the fluid outlet and align the fluid outlet. In some examples, a fluid pump that defines a driveshaft aperture that is connected to the fluid outlet. In some additional examples, a drive motor is attached to the docking station that includes a driveshaft for driving the fluid pump. The docking station may align the fluid outlet so that the driveshaft aperture defined by the fluid pump is co-axially aligned with the driveshaft. This may allow an operator to efficiently take an empty reservoir out of service and replace it with a new reservoir full of fluid.

16 Claims, 4 Drawing Sheets

(56) References Cited

FOREIGN PATENT DOCUMENTS

| | | |
|---|---|---|
| EP | 0553317 | 4/1996 |
| EP | 1100088 | 4/2005 |
| GB | 2238572 | 6/1991 |
| GB | 2347860 | 9/2000 |
| GB | 2421436 | 6/2006 |
| WO | 1986007111 | 12/1986 |
| WO | 1991011333 | 8/1991 |
| WO | 00/27749 A1 | 5/2000 |
| WO | 2003005764 | 1/2003 |
| WO | 2003028775 | 4/2003 |
| WO | 2006027548 | 3/2006 |
| WO | 2009125212 | 10/2009 |
| WO | 2010122299 | 10/2010 |

* cited by examiner

FLUID RESERVOIR DOCKING STATION

TECHNICAL FIELD

This disclosure relates to fluid reservoirs and, more particularly, to docking stations for fluid reservoirs.

BACKGROUND

Fluid reservoirs are used to store and transport fluids in a variety of different industries. For example, in the food industry, fluid containers are used to store condiments, mixes, sauces, beverages and other similar edible fluids. As another example, in the cleaning industry, fluid containers are used to store cleaning and sanitizing agents, detergents, antimicrobial agents and the like.

One of the most common types of disposable fluid containers for commercial customers that require comparatively large volumes of fluid is a bag-in-a-box-style fluid container. Typically, these types of containers are constructed from a flexible, fluid-impermeable bag that is positioned within a comparatively rigid box. The bag prevents the fluid from leaking out of the container while the box provides structural support and puncture resistance for the bag. Oftentimes, bag-in-a-box-style fluid containers have a fluid outlet nozzle extending from the fluid-impermeable bag to outside of the box. The fluid outlet nozzle can be connected to a dispensing device.

As fluid within a disposable fluid container is used up, the container can be replaced with a fresh container full of fluid. Depending on the application, a disposable fluid container may need to be replaced on a regular basis such as a weekly or even daily basis. Ensuring that a fluid outlet nozzle of a container accurately mates with a corresponding dispensing device may be useful for the quick and safe replacement of the container.

SUMMARY

In general, this disclosure is directed to docking stations for fluid reservoirs such as bag-in-a-box type reservoirs. Is some examples, the docking station is configured to receive a fluid outlet connected to the fluid reservoir and align the fluid outlet. For example, the docking station may receive the fluid outlet and align the fluid outlet so that a fluid pump connected to the fluid outlet is aligned with a drive motor attached to the docking station. The drive motor may include a driveshaft that is insertable into the fluid pump and that can operate to mechanically pump fluid out of the fluid reservoir.

To insert a fluid outlet into such an example docking station, a user may slide a flange extending about at least a portion of the fluid outlet into a cavity defined between a receiving surface, a mating surface, and an outlet surface of the docking station. The receiving surface may include a guide channel into which the flange can be inserted and which aligns the flange in a direction substantially parallel to the fluid reservoir. Regardless, the docking station may align the fluid outlet so that an opening in the fluid pump that is designed to receive a driveshaft is coaxially aligned with the driveshaft extending from the docking station. When so aligned, the user can insert the fluid outlet into the docking station until the fluid outlet is in contact with the mating surface and the driveshaft is inserted into the opening in the fluid pump designed to receive the driveshaft. Instead of requiring the user to carefully align the driveshaft on the drive motor with the driveshaft opening on the fluid pump, the docking station may help perform the alignment function.

This may allow an user to efficiently take an empty reservoir out of service and place a new reservoir in service.

In one example, a fluid dispensing system is described that includes a flexible fluid reservoir, a fluid outlet connected to the flexible fluid reservoir, and a fluid pump connected to the fluid outlet, where the fluid pump defines a driveshaft aperture configured to receive a driveshaft for driving the fluid pump. According to the example, the system also includes a drive motor that includes the driveshaft for driving the fluid pump and a docking station connected to the drive motor. The docking station is configured to receive the fluid outlet and align the fluid outlet so that the driveshaft aperture defined by the fluid pump is co-axially aligned with the driveshaft.

In another example, a docking station is described that includes a receiving surface, a mating surface, an outlet surface, and a locking member. The receiving surface is configured to receive a flange extending about at least a portion of a fluid dispensing aperture defined by a fluid outlet connected to a flexible fluid reservoir. The mating surface extends substantially orthogonally from the receiving surface and is configured to mate with a drive motor that includes a driveshaft for driving a fluid pump connected to the fluid outlet. The outlet surface extends substantially orthogonally from the receiving surface and substantially orthogonally from the mating surface and is configured to support the fluid outlet. In addition, the locking member defines an inlet nozzle and outlet nozzle, where the inlet nozzle is configured to be inserted into the fluid outlet and the locking member is configured to releasably lock to the outlet surface so as to mechanically affix the fluid outlet to the outlet surface.

In another example, a fluid dispensing system is described that includes means for storing fluid, a fluid outlet connected to the means for storing fluid, and means for mechanically conveying fluid out of the means for storing fluid, the means for mechanically conveying fluid being connected to the fluid outlet. According to the example, the system also includes means for driving the means for mechanically conveying fluid and means for receiving the fluid outlet and aligning the fluid outlet so that the means for mechanically conveying fluid are aligned with the means for driving.

The details of one or more examples are set forth in the accompanying drawings and the description below. Other features, objects, and advantages will be apparent from the description and drawings, and from the claims.

DETAILED DESCRIPTION

Figure 1:
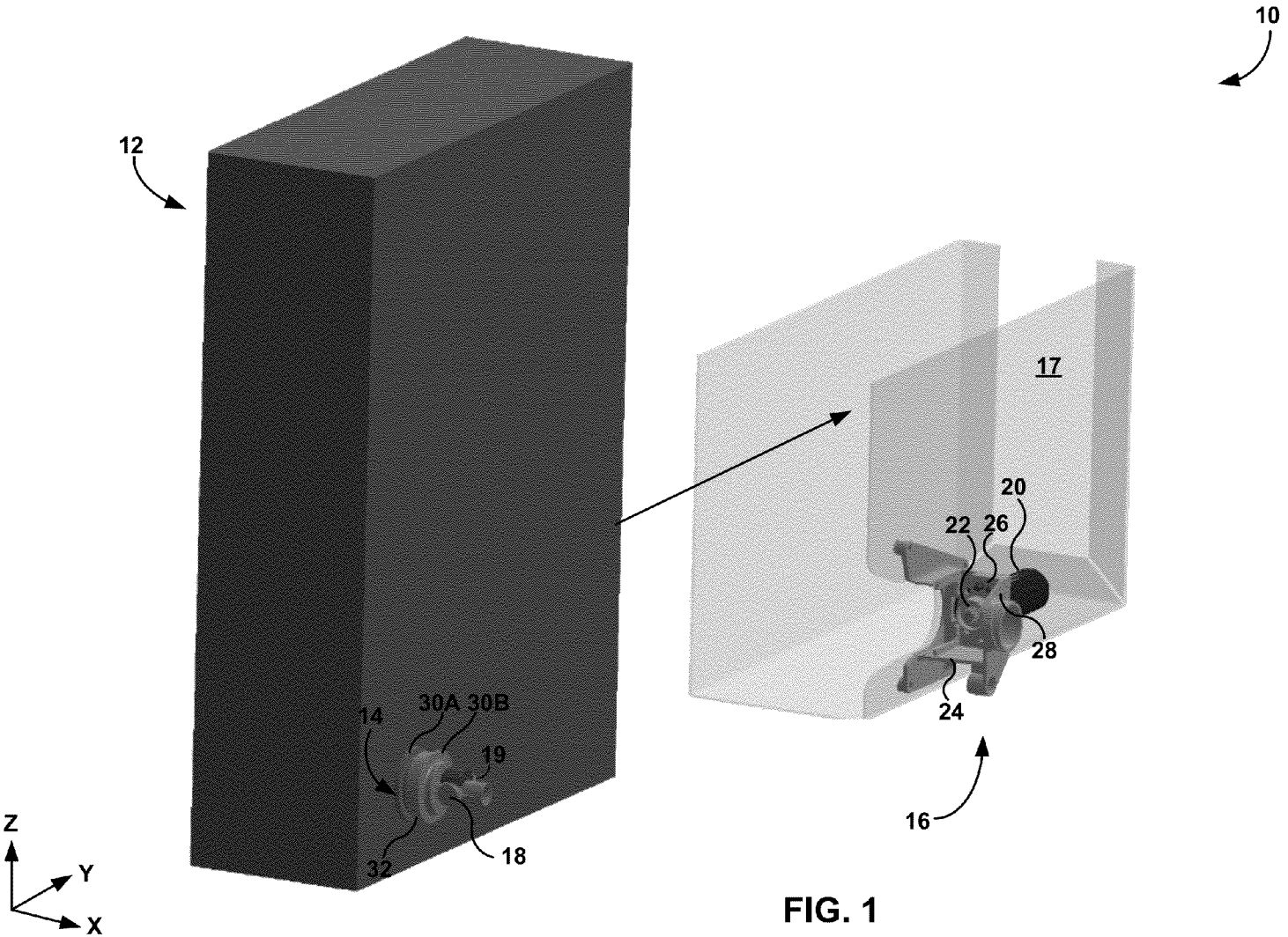
FIG. 1 is a schematic drawing of an example fluid dispensing system that includes an example fluid reservoir, fluid outlet, and docking station.

The following detailed description is exemplary in nature and is not intended to limit the scope, applicability, or configuration of the invention. Rather, the following description provides some practical illustrations for implementing examples of the present invention. Examples of constructions, materials, dimensions, and manufacturing processes are provided for selected elements, and all other elements employ that which is known to those of ordinary skill in the field of the invention. Those skilled in the art will recognize that many of the noted examples have a variety of suitable alternatives.

Fluid reservoirs can be used to transport, store, and dispense flowable materials, such as foods and beverages, cleaning agents, and sanitizing agents, just to name a few. Depending on the application, a fluid reservoir may be permanent and refillable or a fluid reservoir may be disposed after a single use or a limited number of uses. Because disposable fluid reservoirs eliminate the mess and hassle attendant to refilling a reservoir, disposable fluid reservoirs are often used in commercial settings, such as fast food restaurants, hotels, hospitals, car washes, and other similar commercial settings. Typically, upon emptying the fluid in the reservoir, an operator will dispose of the reservoir and replace it with a new disposable reservoir full of fluid. The operator may need to connect the new fluid reservoir to a fluid discharge line, a fluid pump, a fluid pump motor, or other fluid discharge device to place the reservoir in operation and to establish fluid communication between the reservoir and an intended discharge location. If the fluid reservoir is not properly connected, the reservoir can leak or an outlet nozzle of the reservoir can be damaged, potentially rendering the reservoir unsuitable for service.

This disclosure describes a fluid dispensing system that includes a docking station that is configured to mate with an outlet nozzle of a fluid reservoir. The docking station can secure and align the nozzle for subsequent use. For instance, in one example, the system includes a fluid outlet nozzle connected to a flexible fluid reservoir such as, e.g., a flexible bag positioned within a box. The fluid outlet nozzle in this example also includes a fluid pump connected to the fluid outlet nozzle. To connect the reservoir for dispensing product, the fluid outlet nozzle can be connected to an outlet conduit and the fluid pump can be connect to a driveshaft that drives the pump.

Because a fluid nozzle connected to flexible bag may shift in orientation and alignment, it can be particularly challenging to connect the nozzle to dispense product. For example, when configured with a pump, the pump can shift relative to the driveshaft that drives the pump. Further, the fluid outlet can shift relative to a conduit that conveys fluid from the reservoir to a dispensing location. As described in some examples in the present disclosure, a docking station is provided that is connected to a drive motor that includes a driveshaft. The docking station is configured to receive the fluid outlet and align the fluid outlet so that the fluid pump connected to the fluid outlet is aligned with the driveshaft. The alignment function provided by the docking station can help an operator efficiently mate the fluid reservoir with a dispensing device such as, e.g., a pump driveshaft.

For example, the docking station may help facilitate replacement of a disposable fluid reservoir that includes a disposable fluid pump mounted to an outlet nozzle of the fluid reservoir. With such a configuration, each new disposable reservoir full of fluid may include a new pump connected to an outlet nozzle of the reservoir. Placing the new fluid reservoir in service may involve connecting the reservoir to a dispensing conduit and further connecting the new pump associated with the new reservoir to a drive motor. Rather than requiring an operator to carefully align a pump with a driveshaft attached to the drive motor to place the reservoir in service, the docking station may align the nozzle, allowing the operator to easily place the reservoir in service.

Although the configuration of the fluid nozzle and the docking station can vary depending on the application, in one example, the fluid outlet defines a fluid dispensing aperture and a flange extending about at least a portion of the fluid dispensing aperture. Further, the docking station defines a receiving surface configured to receive the flange and a mating surface extending substantially orthogonally from the receiving surface. In this example, the mating surface is configured to mate with the drive motor. Accordingly, when inserting the fluid nozzle into the docking station, the flange can be positioned adjacent the receiving surface of the docking station and advanced toward the mating surface so as to connect the pump to the driveshaft. The docking station can align the fluid outlet so the pump is co-axially aligned with the driveshaft as the pump is advanced toward the driveshaft. The docking station can further secure the pump for subsequent pumping operation.

Figure 2:
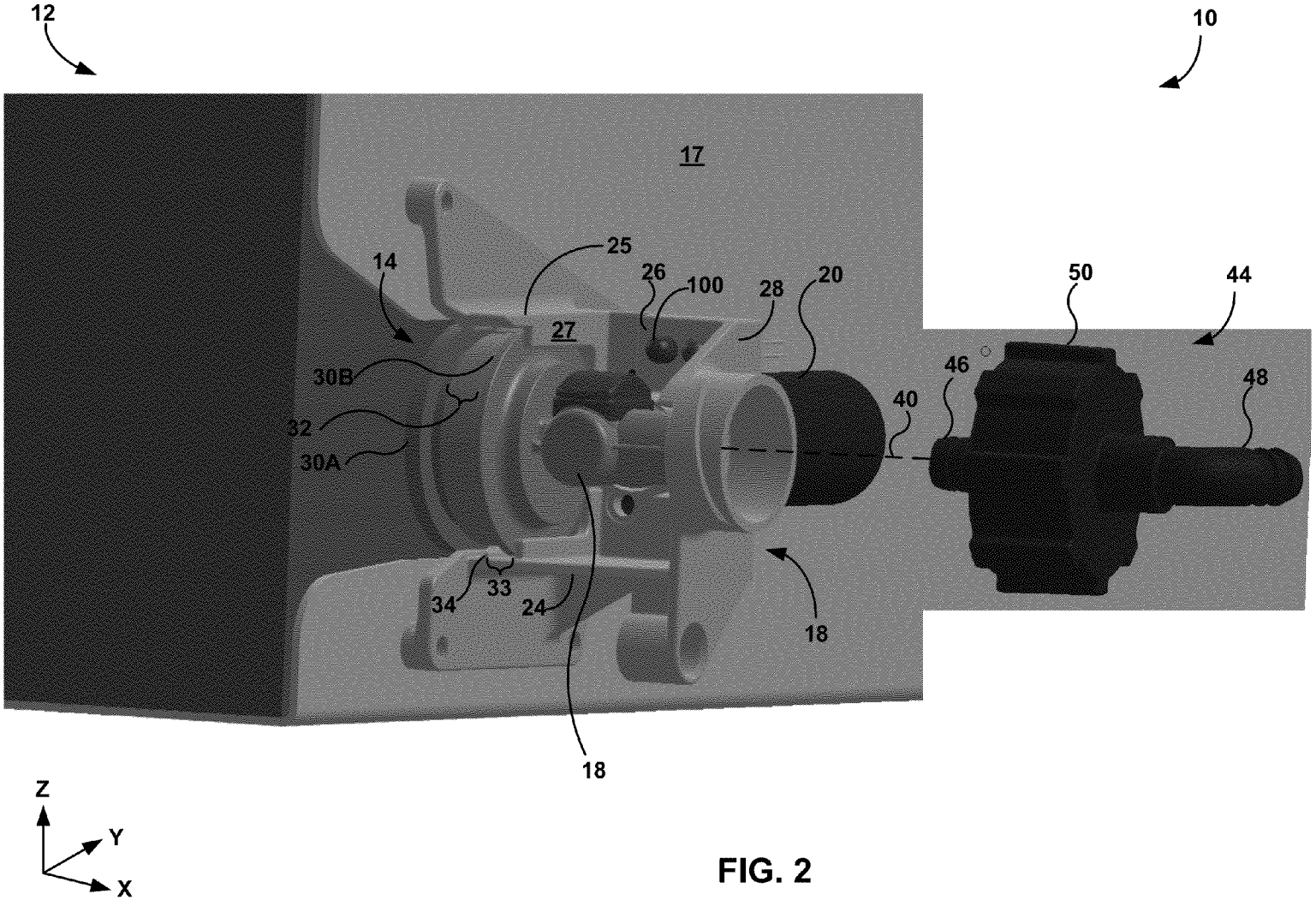
FIG. 2 is a schematic drawing of the example fluid dispensing system of FIG. 1 with the fluid outlet inserted into the docking station.

FIGS. 1 and 2 are schematic drawings of an example fluid dispensing system 10, which includes a fluid reservoir 12, a fluid outlet 14, and a docking station 16. Fluid outlet 14 is shown outside of and insertable into docking station 16 in FIG. 1, while fluid outlet 14 is shown inserted into docking station 16 in FIG. 2. Fluid outlet 14 is connected to and in fluid communication with fluid reservoir 12 such that fluid can be discharged from the fluid reservoir through the fluid outlet. Docking station 16 is configured to receive fluid outlet 14 and align the fluid outlet for dispensing operations. In particular, in the example of FIG. 1, docking station 16 is configured to receive fluid outlet 14 by sliding the fluid reservoir in the Y-direction shown on FIG. 1 until the fluid outlet is positioned adjacent an abutting surface of the docking station. In other examples, docking station 16 may receive fluid outlet 14 from a different direction than shown on FIG. 1, which may depend, for example, on the arrangement of the fluid outlet relative to fluid reservoir 12 and the configuration of the docking station. For instance, in one example, docking station 16 receives fluid outlet 14 by moving fluid reservoir 12 in the negative Z-direction indicated on FIG. 1 relative to the docking station.

Fluid dispensing system 10 also includes a fluid pump 18 and a fluid pump drive motor 20 (hereinafter "drive motor 20"). Fluid pump 18 is connected to fluid outlet 14 and configured to mechanically pump fluid from fluid reservoir 12 to a dispensing location. Drive motor 20 is configured to provide a driving force for driving fluid pump 18. Specifically, in the example of FIG. 1, drive motor 20 includes a driveshaft 22 that can be inserted into a corresponding driveshaft aperture 19 defined by fluid pump 18. During operation, drive motor 20 can turn driveshaft 22 so as to convey mechanical energy from the fluid pump motor to the fluid pump, thereby pumping fluid out of fluid reservoir 12 via fluid outlet 14. In some examples, driveshaft 22 defines a spline drive that is mechanically coupled to a rotor or other fluid movement device within fluid pump 18 for mechanically transferring fluid. Typically, a spline drive includes a series of projections extending radially from a shaft that fit into corresponding slots in a shaft opening.

Docking station 16 is configured to receive a fluid outlet connected to fluid reservoir 12. Docking station 16 is illustrated as being attached to a fluid reservoir guide bracket 17. Fluid reservoir guide bracket 17 is sized and shaped to receive fluid reservoir 12 such that fluid reservoir 12 can be inserted into the fluid reservoir guide bracket while fluid outlet 14 is inserted into the docking station attached to the guide bracket. Fluid reservoir guide bracket 17 may help position fluid outlet 14 for insertion into docking station 16. This may help a user quickly exchange an empty reservoir for a fresh reservoir full of fluid. That being said, in other examples, docking station 16 may receive fluid outlet 14 without being attached to a fluid reservoir guide bracket.

In general, fluid reservoir 12 may be any type of container that defines a fluid impermeable structure for storing fluid. Fluid reservoir 12 may be a rigid container such as a box, bottle, drum, or other container formed of a rigid material (e.g., glass, metal, a rigid thermoplastic). Alternatively, fluid reservoir 12 may be a flexible container such as a bag or other structure that does not define a rigid, fixed shape. A flexible container may, but need not, define a volume that expands and contracts in response to increasing and decreasing fluid volumes in the container.

In the example of FIG. 1, fluid reservoir 12 is generally illustrated in the style of a bag-in-a-box-type container. Bag-in-a-box-style containers may include a flexible bag positioned within a box that is more rigid than the bag. For example, a bag-in-a-box container may be fabricated from a flexible plastic bag positioned within a cardboard box. The bag and box may or may not be heat sealed together. As fluid reservoir 12 in FIG. 1 is illustrated as a generally rectangularly-shaped box that includes a fluid impermeable bag in the box, the remainder of the present disclosure generally refers to an example configuration of docking station 16 where the docking station is designed to receive a fluid outlet connected to a bag-in-a-box-style reservoir. However, other configurations of docking station 16 are possible in accordance with the present disclosure, and it should be appreciated that the disclosure is not limited to any particular type of docking station. For example, docking station 16 can be configured to receive a fluid outlet nozzle attached to a bottle, a drum, or other flexible or inflexible container, as will be appreciated by those of skill in the art.

In use, fluid reservoir 12 can store any suitable types of fluids and the disclosure is not limited to a fluid reservoir that stores a particular type of fluid. Example fluids include cleaning agents, sanitizing agents, foods, beverages, lubricants, chemical agents, and other flowable fluids. Further, although fluid reservoir 12 is described as storing a fluid, the fluid need not be a pure liquid. The fluid reservoir may store viscous flowable materials, semi-liquid fluids, or the like. In different examples, the fluid within fluid reservoir 12 may be stored at ambient pressure or a positive pressure.

To help secure and align fluid outlet 14 for dispensing fluid from fluid reservoir 12, fluid outlet 14 may be inserted into docking station 16 in accordance with this disclosure. Docking station 16 can assume different configurations; however, in the example of FIG. 1 (which is shown in an exploded view in FIG. 2), docking station 16 includes a receiving surface 24, a mating surface 26, and an outlet surface 28. Receiving surface 24 receives fluid outlet 14 and, in some examples, supports the fluid outlet from the Z-direction shown on FIGS. 1 and 2. Mating surface 26 extends substantially orthogonally from receiving surface 26 (i.e., in the Z-direction shown on FIGS. 1 and 2). Mating surface 26 mates with drive motor 20, e.g., to secure the drive motor to the docking station and fix an orientation of driveshaft 22 relative to the docking station. Outlet surface 28 extends substantially orthogonally from both receiving surface 24 and mating surface 26 (i.e., in the Y-Z plane shown on FIGS. 1 and 2). Outlet surface 28 may support fluid outlet 14 and, in some examples, mate with a locking member to mechanically affix the fluid outlet to the outlet surface. By positioning fluid outlet 14 between receiving surface 24, mating surface 26, and outlet surface 28, the fluid outlet may be aligned so that driveshaft 22 inserts into fluid pump 18 as the fluid outlet is inserted into docking station 16. Further, positioning fluid outlet 14 between receiving surface 24, mating surface 26, and outlet surface 28 may secure the fluid outlet, e.g., to prevent the fluid outlet from disconnecting from a conduit subsequently attached to the outlet.

In combination, receiving surface 24, mating surface 26, and outlet surface 28 define a partially-enclosed cavity into which fluid outlet 14 and connected fluid pump 18 can be inserted. For example, to insert fluid outlet 14 into docking station 16 in the example of FIGS. 1 and 2, a user can slide fluid outlet 14 from the Y-direction until the fluid outlet is positioned adjacent to and in contact with mating surface 26. As described in greater detail below, docking station 16 may include features that align and secure the fluid outlet to facilitate pumping operation. In one example, docking station 16 includes a guide slot that aligns fluid outlet 14 so that the driveshaft aperture 19 defined by fluid pump 18 is co-axially aligned with driveshaft 22. When aligned, driveshaft 22 can be inserted into the driveshaft aperture by advancing fluid outlet 14 until the fluid outlet is positioned adjacent mating surface 26. In another example, docking station 16 is configured to receive a locking member 44 that secures fluid outlet to outlet surface 28. The locking member may help prevent fluid outlet 14 from disconnecting from a conduit (not shown) that conveys fluid from fluid reservoir 12 to a downstream dispensing location. For example, the locking member may help prevent fluid outlet 14 from disconnecting from the conduit when pumping to a downstream dispensing location that is at a pressure above ambient pressure, which may require higher pressures within the conduit that promote separation from the fluid outlet.

Docking station 16 is configured to receive fluid outlet 14. Fluid outlet 14 is in fluid communication with a volume of fluid stored within fluid reservoir 12. In some examples, such as the example shown in FIGS. 1 and 2, fluid outlet 14 define a nozzle that projects from an exterior surface of fluid reservoir 12. In other examples, fluid outlet 14 is flush with or recessed into an exterior surface of fluid reservoir 12. In either set of examples, fluid outlet 14 may be connected to fluid pump 18 for mechanically conveying fluid.

Fluid pump 18 is a device that transfers fluid from fluid reservoir 12 to a downstream dispensing location. In various examples, fluid pump 18 may be a gear pump, a screw pump, a diaphragm pump, or other type of devices that conveys fluid. In one example, fluid pump 18 is a two-part pump that includes a central rotor and a housing that includes a flexible diaphragm. The rotor may have indents that pick up fluid from an input side and transport the fluid around the housing to an output port. The flexible diaphragm on the housing may push the fluid into the output, emptying the indents on the rotor. The rate of flow of the pump may be controlled by the rate of rotation of the rotor. Such a pump is commercially available from Quantex Arc Ltd. It should be appreciated, however, that fluid dispensing system 10 may include any suitable type of pump and the disclosure is not limited in this respect.

Independent of the specific type of pump used for fluid pump 18, the fluid pump may be permanent or disposable. Fluid pump 18 may be permanent or semi-permanent in that the same pump may be used for multiple different reservoirs of fluid. That is, the same fluid pump 18 may be transferred from an old reservoir to a new reservoir as the new reservoir replaces the old reservoir. Alternatively, fluid pump 18 may be disposable such that each new fluid reservoir 12 inserted into docking station 16 includes a new pump attached to that reservoir. Including a new pump with each new fluid reservoir inserted into docking station 16 may provide a more sanitary system than reusing the same pump for multiple different reservoirs of fluid.

When configured with fluid pump 18, the fluid pump may be connected to fluid outlet 14 in any suitable orientation relative to the fluid outlet. Fluid pump 18 may be connected either directly to fluid outlet 14 or with the aid of an extension or intermediate conduit (not shown in the example of FIGS. 1 and 2). In the example of FIGS. 1 and 2, fluid pump 18 is directly connected to fluid outlet 14 at a distal end of the outlet extending away from fluid reservoir 12. In particular, in the illustrated example, fluid pump 18 projects distally from a distal most end of fluid outlet 14. In some examples, fluid pump 18 is mechanically attached to fluid outlet 14. For example, a mechanical fixation element such as, e.g., bolts, screws, adhesive, or the like may be used to mechanically attach the fluid pump to the fluid outlet. In other examples, fluid pump 18 is attached to fluid outlet 14 without the aid of a mechanical fixation element. For example, fluid pump 18 may include an inlet nozzle that has an exterior perimeter smaller than the interior perimeter of fluid outlet 14. The inlet nozzle of fluid pump 18 can be friction fit into fluid outlet 14 to secure the fluid pump to the fluid outlet without the aid of a mechanical fixation element. Additionally or alternatively, fluid pump 18 may attach over fluid outlet 14, e.g., by being secured about an exterior perimeter of the fluid outlet. During operation, fluid can flow out of fluid reservoir 12 and through fluid outlet 14 via fluid pump 18 to a dispensing location.

In the example of FIGS. 1 and 2, fluid outlet 14 defines a fluid dispensing aperture (which may be an opening in fluid communication with fluid pump 18 for pumping fluid out of fluid reservoir 12) and at least one flange which, in the illustrated example, is shown as two flanges 30A and 30B (collectively "flange 30"). Flange 30 extends at least partially, and in some examples, fully about a perimeter of the fluid dispensing aperture. Flange 30 may define a rim that extends radially outward away from fluid outlet 14. Flange 30 may strengthen the connection between fluid reservoir 12 and fluid outlet 14 and/or help align the fluid outlet when the outlet is inserted into docking station 16.

For example, flange 30A in FIGS. 1 and 2 may provide structural rigidity between fluid outlet 14 and fluid reservoir 12, e.g., by expanding the surface area over which forces on the fluid outlet are transferred to the fluid reservoir. In some examples, flange 30A is positioned adjacent to (e.g., flush with) an exterior surface of fluid reservoir 12 (e.g., in the Y-Z plane illustrated in FIGS. 1 and 2). By contrast, flange 30B may be spaced away from fluid reservoir 12 and used to help align fluid outlet 14 while the fluid outlet is being inserted into docking station 16. Flange 30B is illustrated as being parallel to (i.e., parallel Y-Z planes) and spaced from flange 30A so as to define a channel 32 between the two flanges. Channel 32 may be a recessed area between projecting edges of flange 30A and flange 30B that may help align outlet 14 upon being inserted into docking station 16. Further, while fluid outlet 14 in the example of fluid dispensing system 10 includes two flanges, in other examples, the fluid outlet may include fewer flanges (e.g., none, one) or more flanges (e.g., three, four, or more).

To place fluid reservoir 12 in service for dispensing fluid, fluid pump 18 projecting from fluid outlet 14 may be connected drive motor 20. In particular, in the example of FIGS. 1 and 2, driveshaft 22 coupled to drive motor 20 can be inserted into a corresponding driveshaft aperture 19 defined in the fluid pump to place the fluid pump in service. The driveshaft aperture, which may be an opening that extends partially or fully through fluid pump 18, can be configured (e.g., sized and/or shaped) to receive the driveshaft. Once inserted into driveshaft aperture 19, drive motor 20 can turn the driveshaft to engage fluid pump 18 for delivering fluid from the fluid reservoir.

In practice, inserting driveshaft 22 into the driveshaft aperture 19 defined in fluid pump 18 may be challenging because fluid outlet 14, and hence driveshaft aperture 19 connected to the fluid outlet, may shift relative to fluid reservoir 12. For example, when fluid reservoir 12 includes a flexible bag (e.g., a bag-in-box-style reservoir) the surface of the bag to which fluid outlet 14 is attached may flex and move. This movement may cause driveshaft aperture 19 to move in the X-, Y-, and/or Z-directions indicated on FIGS. 1 and 2 when attempting to insert driveshaft 22 into the driveshaft aperture.

Docking station 16 may help align the driveshaft aperture with driveshaft 22 to facilitate mating between the components. For example, docking station 16 may fix the orientation of driveshaft 22 in three-dimensional space and guide placement of driveshaft aperture 19 defined by fluid pump 18 in three-dimensional space so that the aperture and driveshaft are aligned. In one example, docking station 16 is configured to align the driveshaft aperture with the driveshaft so that the components are coaxially positioned about an axis passing through a center of both the aperture and the driveshaft. When so aligned, driveshaft 22 may be inserted into the driveshaft aperture by advancing one of the components (e.g., the fluid pump that defines the driveshaft aperture) towards the other of the components (e.g., the driveshaft operably connected to the drive motor), e.g., linearly along the axis. In this way, docking station 16 may align driveshaft aperture 19 defined by fluid pump 18 with driveshaft 22 for mechanically mating the components.

Figure 3:
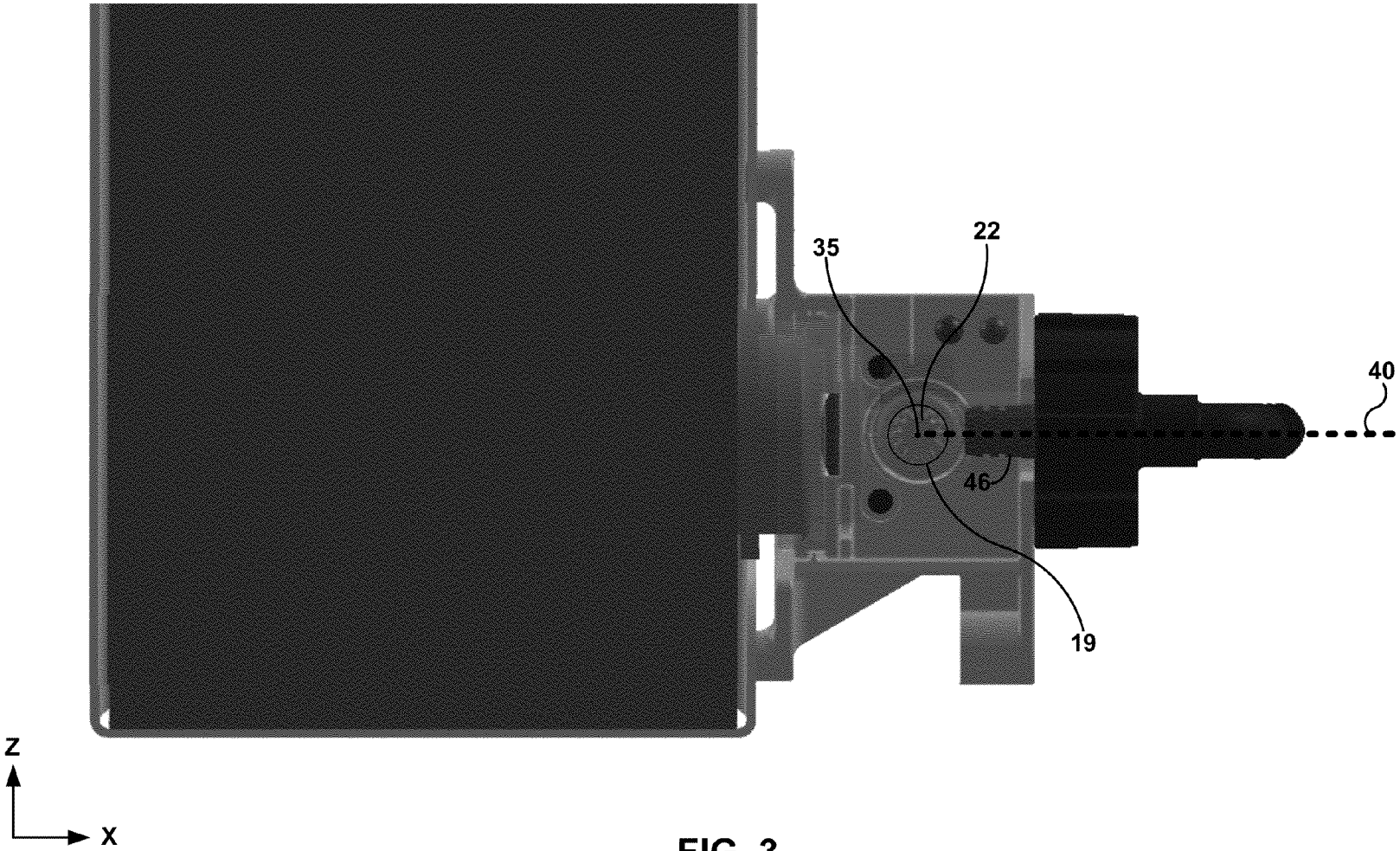
FIG. 3 is a cross-sectional illustration of an example portion of the fluid dispensing system of FIG. 2.

FIG. 3 is a cross-sectional illustration of a portion of fluid dispensing system 10 from FIG. 2 (with fluid outlet 14 inserted into docking station 16) taken along the X-Z plane illustrated in FIG. 2. As seen in this example, a distal end of driveshaft 22 is inserted into driveshaft aperture 19 so that the driveshaft and aperture are coaxially aligned about a common axis 35. Further, in this example, teeth of driveshaft 22 project into corresponding recesses defined around an interior perimeter of driveshaft aperture 19, while recesses defined between adjacent teeth of driveshaft 22 are filled with corresponding teeth extending between adjacent recesses defined around an interior perimeter of driveshaft aperture 19.

In some instances, even when driveshaft 22 is aligned (e.g., coaxially) with the driveshaft aperture defined by fluid pump 18, the driveshaft may be difficult to insert into the driveshaft aperture if mechanical engagement features on the driveshaft not properly oriented with corresponding engagement features about the driveshaft aperture. For instance, driveshaft 22 and driveshaft aperture 19 defined by fluid pump 18 may be configured to mate via a spline drive, where one of the components includes a plurality of radial projections and the other of the components includes a plurality of corresponding radial slots. When so configured, the radial projections on driveshaft 22 or driveshaft aperture 19 may be out of rotational alignment with the corresponding slots on the other of the components, even though the components are coaxially aligned. In such a situation, driveshaft 22 may resist entering driveshaft aperture 19 when fluid outlet 14 is inserted into docking station 16.

Figure 4:
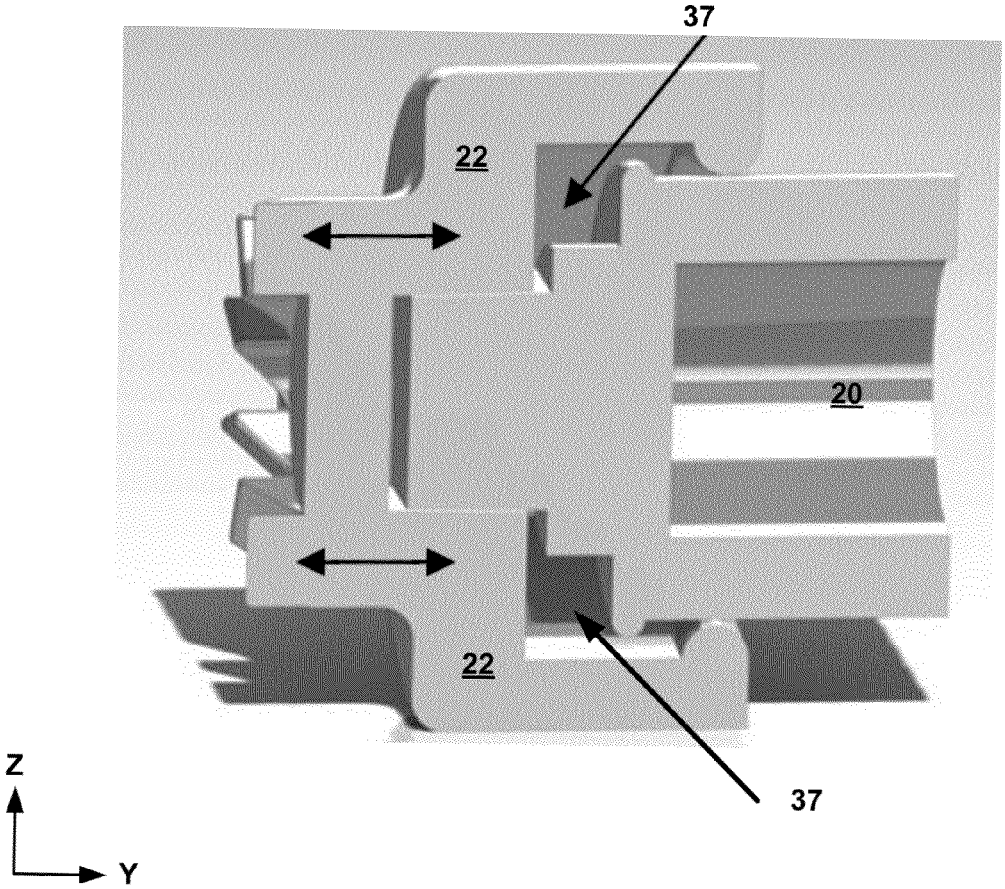
FIG. 4 is a cross-sectional drawing of an example driveshaft and drive motor that may be used in the example fluid dispensing system of FIGS. 1 and 2.

FIG. 4 is a cross-sectional drawing of an example driveshaft 22 and drive motor 20, which may be used in the example fluid dispensing system 10 of FIGS. 1 and 2. As shown, driveshaft 22 is operably coupled to drive motor 20 and is configured to bias away from the drive motor in the Y-direction shown on FIG. 4. A spring, piston, or biasing mechanism 37 may be positioned between the driveshaft and the drive motor to bias the driveshaft away from the drive motor. In instances in which fluid outlet 14 is inserted into docking station 16 while the radial projections on driveshaft 22 or the driveshaft aperture are out of rotational alignment with the corresponding slots on the other of the components, the driveshaft can retract from the fluid outlet as the fluid outlet is inserted into the docking station. Upon subsequently activating drive motor 20, driveshaft 22 may rotate until the radial projections or slots are rotationally aligned with the corresponding slots or projections on driveshaft aperture 19. Upon aligning, driveshaft 22 may bias forward to enter driveshaft aperture 19, thereby mechanically mating the two components.

With further reference to FIG. 2, docking station 16 includes previously-described receiving surface 24, mating surface 26, and outlet surface 28. Receiving surface 24 receives fluid outlet 14 by positioning an edge of flange 30 on the receiving surface. Receiving surface 24 may define any suitable size and shape, and the size and shape of the surface may vary, e.g., based on the size and shape of fluid outlet 14 and/or flange 30. For example, receiving surface 24 may define a planar surface that extends outwardly in a direction projecting away from an exterior surface of fluid reservoir 12 as shown in FIG. 2. In another example, receiving surface 24 may define a non-planar surface (e.g., a curved surface), which may or may not also extend outwardly in a direction projecting away from an exterior surface of fluid reservoir 12. Receiving surface 24 may fix the relative orientation of fluid outlet 14 and/or driveshaft 22 in at least one dimension (e.g., the Z-direction indicated on FIG. 2).

In some examples, docking station 16 includes a plurality of receiving surfaces (e.g., two, three, or more receiving surfaces) that receive flange 30, e.g., for aligning and securing fluid outlet 14 for dispensing fluid. In the example of FIG. 2, docking station includes receiving surface 24 and a second receiving surface 25 positioned parallel to and spaced apart from receiving surface 24. In combination, receiving surface 24, second receiving surface 25, and at least a portion of mating surface 26 define a cavity bounded at least partially on three sides that is configured (e.g., sized and/or shaped) so that flange 30 can be inserted into the cavity. In some examples, docking station 16 also includes a flange wall 27 extending parallel to flange 30 and/or an exterior surface of fluid reservoir 12 that bounds fluid outlet 14 in a direction substantially orthogonal to the exterior surface of fluid reservoir 12.

By inserting flange 30 into the cavity defined by receiving surface 24, second receiving surface 25, mating surface 26, and flange wall 27, docking station 16 may fix the relative orientation of fluid outlet 14 and/or driveshaft 22 in at least two dimension (e.g., the X- and Z-directions indicated on FIG. 2), thereby aligning the driveshaft with the driveshaft aperture in the at least two dimensions. Specifically, in the example of FIG. 2, when fluid outlet 14 is positioned within the cavity, the fluid outlet may be bounded in the negative Z-direction by receiving surface 24, in the positive Z-direction by second receiving surface 25, in the positive Y-direction by mating surface 26, and in the positive X-direction by flange wall 27.

To assist a user in inserting fluid outlet 14 into docking station 16, docking station 16 can be configured with features to help the user guide and align flange 30 within the cavity defined by receiving surface 24, second receiving surface 25, mating surface 26, and flange wall 27. For instance, in the example of FIG. 2, docking station 16 includes a guide channel 33 defined between flange wall 27 and a rib 34 positioned parallel to flange wall 27. Guide channel 33 may help a user guide fluid outlet 14 into docking station 16. When introducing fluid outlet 14 into docking station 16, an edge portion of flange 30B can be inserted into guide channel 33 while rib 34 is inserted into the channel 32 defined between flange 30A and flange 30B. In this way, docking station 16 can help guide fluid outlet 14 and, in particular, flange 30 of fluid outlet 14 into the docking station, helping to align the flange in a direction substantially parallel to fluid reservoir 12 (e.g., so the flange is parallel to the fluid reservoir in the Y-Z plane indicated on FIG. 2). Although not shown in FIG. 2, when docking station 16 includes second receiving surface 25, the second receiving surface can also include a guide channel corresponding to guide channel 33 that receives an edge portion of flange 30B opposite the portion inserted into guide channel 33.

Independent of the number of guide channels defined by docking station 16, in some examples, one or more the guide channels defined by the docking station (e.g., all of the guide channels when the docking station is configured with multiple guide channels) may taper in width (e.g., in the X-direction indicated on FIG. 2) as the guide channel extends from farther away from drive motor 22 to closer to the guide motor (i.e., in the Y-direction indicated on FIG. 2). Such a configuration may provide a comparatively wide guide channel into which a user can insert flange 30B, while the comparatively narrower portion of the guide channel adjacent drive motor 20 may reduce or eliminate axially movement (e.g., in the X-direction indicated on FIG. 2) of fluid outlet 14, thereby helping to secure the fluid outlet and align the fluid outlet relative to driveshaft 22.

While flange 30 is illustrated as defining a substantially circular cross-sectional shape (i.e., in the Y-Z plane indicated on FIG. 2), in other examples, flange 30 can define other shapes. Flange 30 can define any polygonal (e.g., square, hexagonal) or arcuate (e.g., circular, elliptical) shape, or even combinations of polygonal and arcuate shapes. In some examples, flange 30 defines a guide surface configured to be inserted into guide channel 33. The guide surface of flange 30 may be an edge portion of the flange that is configured to rotationally align the flange (e.g., while being inserted into docking station 16) about an axis extending substantially orthogonally from an exterior surface of fluid reservoir 12. For example, flange 30 may include a guide surface that rotationally aligns the flange (i.e., in the Y-Z plane indicated on FIG. 2) about an axis 40 extending through a center of the fluid dispensing aperture defined by fluid outlet 14. Such an arrangement may help ensure that the drive aperture defined by fluid pump 18 is properly aligned with driveshaft 22 as fluid outlet 14 advances into docking station 16.

Figure 5:
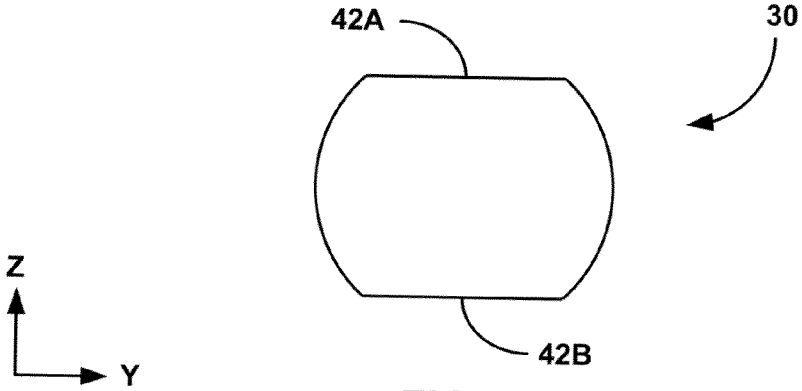
FIG. 5 is a cross-sectional illustration of an example flange that may be used in the example fluid dispensing system of FIGS. 1 and 2.

FIG. 5 is a cross-sectional illustration of an example flange 30 that includes at least one guide surface which, in the illustrated example, is shown as two guide surfaces 42A and 42B. Guide surfaces 42A and 42B are positioned on opposing sides of flange 30. Guide surfaces 42A and 42B are illustrated as chamfered or planar edges on the otherwise substantially circular flange. Such guide surfaces may rotationally align (e.g., square) fluid outlet 14 as the fluid outlet is inserted into guide channel 33 defined by docking station 16. Although guide surfaces 42A and 42B are shown as chamfered edges, other types of guide edges are both possible and contemplated.

Docking station 16 of fluid dispensing system 10 (FIGS. 1 and 2) also includes mating surface 26. Mating surface 26 mates with drive motor 20, e.g., to secure the drive motor to the docking station and fix an orientation of driveshaft 22 relative to the docking station. Drive motor 20 can mate to docking station 16 prior to inserting fluid outlet 14 into the docking station. As shown in FIGS. 1 and 2, when drive motor 20 is mated with mating surface 26, driveshaft 22 may extend through an aperture defined in the mating surface such that, when fluid outlet 14 is inserted into docking station 16, the driveshaft is inserted into driveshaft aperture 19 with the fluid pump positioned on one side of mating surface 26 and the drive motor positioned on an opposite side of the mating surface. In some examples, drive motor 20 is mechanically attached to mating surface 26. For example, a mechanical fixation element such as, e.g., bolts, screws, adhesive, or the like may be used to mechanically attach the drive motor to the mating surface. In other examples, drive motor is mated to mating surface 26 without the aid of a mechanical fixation element.

Mating surface 26 may define any suitable size and shape, and the size and shape of the surface may vary, e.g., based on the size and shape of fluid outlet 14 and/or flange 30 and/or drive motor 20. For example, mating surface 26 may define a planar surface that extends outwardly in a direction projecting away from an exterior surface of fluid reservoir 12 as shown in FIG. 2. In another example, mating surface 26 may define a non-planar surface (e.g., a curved surface), which may or may not also extend outwardly in a direction projecting away from an exterior surface of fluid reservoir 12. Mating surface 26 may fix the relative orientation of fluid outlet 14 and/or driveshaft 22 in at least one dimension (e.g., the Y-direction indicated on FIG. 2).

Drive motor 20 may be implemented as any device that is configured to convert energy to mechanical motion for rotating drive shaft 22. In different examples, drive motor 20 may be an electric motor, a pneumatic motor, or a hydraulic motor. Other types of motors may also be used in accordance with the disclosure.

During operation, fluid pump 18 can receive fluid from fluid reservoir 12, pressurize the fluid to a pressure greater than the pressure in the reservoir, and discharge the fluid to a downstream dispensing location. Depending on the application, fluid pump 18 may generate pressure in a conduit (not shown) that conveys fluid from the pump to the dispensing location that causes the conduit to try and disengage from fluid outlet 14. For this reason, docking station may include an outlet surface that helps secure the fluid outlet, e.g., to prevent the fluid outlet from disconnecting from a conduit subsequently attached to the outlet.

In the example of FIGS. 1 and 2, docking station includes outlet surface 28, which is positioned farther away from fluid reservoir 12 than fluid outlet 14. Outlet surface 28 extends substantially orthogonally from both receiving surface 24 and mating surface 26 (i.e., in the Y-Z plane shown on FIGS. 1 and 2). Outlet surface 28 may or may not physically support fluid outlet 14. In some examples, outlet surface 28 may be configured to mate with a locking member to mechanically affix the fluid outlet to outlet surface.

Fluid dispensing system 10 in FIG. 2 includes locking member 44. Locking member 44 includes an inlet nozzle 46, an outlet nozzle 48, and an attachment member 50. Inlet nozzle 46 can be inserted into fluid outlet 14 and, in particular, a discharge end of fluid pump 18 attached to the fluid outlet. Outlet nozzle 48 can be connected to a conduit (not shown) that conveys fluid from fluid pump 18 to a downstream dispensing location. Attachment member 50 can be used to attach and secure locking member 44 to outlet surface 28. For instance, after inserting fluid outlet 14 into docking station 16, a user can insert inlet nozzle 46 of locking member 44 into fluid outlet 14 though an opening defined in outlet surface 28. The user can then secure the locking member to the outlet surface using attachment member 50.

Depending on the configuration of the fluid dispensing system, in some examples when inlet nozzle 46 is inserted into fluid outlet 14 and attachment member 50 is secured to outlet surface 28, an axis extending through a center of the inlet nozzle may intersect a substantially orthogonal axis passing through a center of driveshaft 22. FIG. 3 is a cross-sectional illustration of such an example arrangement. As shown in this example, inlet nozzle 46 is inserted the fluid outlet and an axis 40 extends through a center of both the inlet nozzle and the fluid dispensing aperture defined by the fluid outlet. Axis 40 is substantially orthogonal to and intersects an axis 35 extending through a center of driveshaft 22, which is inserted into driveshaft aperture 19.

With the example of FIG. 2, the user screws attachment member 50 onto a substantially circular threaded surface projecting away from a planar portion of outlet surface 28. In some examples, attachment member 50 is configured to secure to outlet surface 28 by screwing the attachment member a half turn (180 degrees) or less, allowing a user to quickly secure the attachment member to the outlet surface. In different examples, attachment member 50 may be configured to secure to outlet surface 28 using a different type of attachment feature such as, e.g., clips, bolts, or the like. By mechanically affixing fluid outlet 14 to outlet surface 28 via locking member 44, vibration motion imparted to the fluid outlet during operation of fluid pump 18 may be attenuated. This may help prevent the fluid outlet from disconnecting from a conduit attached to the outlet. This may also help prevent fluid pump 18 from disengaging with drive motor 20 (e.g., driveshaft 22 coming out of driveshaft aperture 19), even when pumping against pressure.

When mating fluid outlet 14 with docking station 16, it may be useful if an user can readily determine when the fluid outlet is sufficiently inserted into the docking station such that locking member 44 can be secured to outlet surface 28 and/or fluid pump 18 can be activated. In some examples, the user determines that fluid outlet 14 is sufficiently inserted into docking station 16 by inserting the fluid outlet into the docking station until the fluid outlet is adjacent to and in contact with mating surface 26 of the docking station. The tactile feedback associated with contacting mating surface 26 may indicate to the user that fluid outlet 14 is sufficiently inserted into docking station 16. In other examples, fluid dispensing system 10 may provide a visual and/or audible indication when fluid outlet 14 is sufficiently inserted into docking station 16.

In the example of FIGS. 1 and 2, docking station 16 includes a docking light 100. Docking light 100 may illuminate when fluid outlet 14 is sufficiently inserted into docking station 16. For example, inserting fluid outlet 14 to a desired location in docking station 16 may close a circuit that causes docking light 100 to activate. The activated docking light may indicate to the user that locking member 44 can be secured to outlet surface 28 and/or fluid pump 18 can be activated. By contrast, deactivation of docking light 100 may indicate to the user that fluid outlet 14 has moved out of proper position with respect to docking station 16 and should be repositioned.

In addition to or in lieu of docking light 100, fluid dispensing system 10 may include a variety of other features to sense and/or indicate operational performance of the fluid dispensing system. In one example, fluid dispensing system 10 includes a product delivery indicator to indicate when fluid is flowing through fluid outlet 14. The product delivery indicator may provide an indication of whether fluid is or is not flowing through fluid outlet 14, e.g., during operation of fluid pump 18. If fluid is flowing through fluid outlet 14, the product delivery indicator may provide a proof-of-delivery (POD) indication. If fluid is not flowing through fluid outlet 14, for example because fluid reservoir 12 is empty, the product delivery indicator may provide an out-of-product-alert (OOPA) indication. The fluid delivery indicator may be an audible indicator, a visual (e.g., an LED) indicator, a tactile indicator, or a combination thereof. In one example, the fluid delivery indicator is a light that activates when fluid is flowing through fluid outlet 14 and that deactivates when fluid is not detected as flowing through fluid outlet 14.

In some examples, a fluid delivery indicator for fluid dispensing system 10 may be implemented as a check valve that moves in response to fluid flowing through fluid outlet 14. The check valve can be positioned in fluid outlet 14, fluid pump 18, locking member 44, or another location suitable for detecting fluid flow through fluid outlet 14. The check valve may move in response to fluid flow through fluid outlet 14, causing activation of the product delivery indicator. For example, the check valve may include a rare earth magnet that moves relative to a Hall Effect sensor as fluid flows or stops flowing through fluid outlet 14. The Hall Effect sensor may detect changes in a magnetic field caused by the moving check valve, resulting in activation or deactivation of the product delivery indicator.

As another example, fluid dispensing system 10 can include an radio frequency identification (RFID) tag reader positioned to read an RFID tag on fluid reservoir 12. When fluid reservoir 12 includes an RFID tag and is inserted into docking station 16, the RFID tag read can read information stored on the RFID tag. For example, the RFID tag may store information indicative of the fluid stored within the reservoir and information indicating what to order to order as the fluid is depleted (e.g., manufacturer names, product codes, or the like).

Various examples have been described. These and other examples are within the scope of the following claims.

The invention claimed is:

1. A fluid dispensing system comprising:

a flexible fluid reservoir;

a fluid outlet connected to the flexible fluid reservoir, the fluid outlet defining a fluid dispensing aperture and a flange extending about at least a portion of the fluid dispensing aperture;

a fluid pump connected to the fluid outlet, the fluid pump defining a driveshaft aperture configured to receive a driveshaft for driving the fluid pump;

a drive motor that includes the driveshaft for driving the fluid pump;

a docking station connected to the drive motor and configured to receive the fluid outlet and align the fluid outlet so that the driveshaft aperture defined by the fluid pump is co-axially aligned with the driveshaft, wherein the docking station defines a receiving surface configured to receive the flange, a mating surface extending substantially orthogonally from the receiving surface and configured to mate with the drive motor, and an outlet surface extending substantially orthogonally from the receiving surface and substantially orthogonally from the mating surface, the outlet surface being configured to support the fluid outlet; and a locking member that defines an inlet nozzle and outlet nozzle, wherein the inlet nozzle is configured to be inserted into the fluid outlet and the locking member is configured to releasably lock to the outlet surface so as to mechanically affix the fluid outlet to the outlet surface.

2. The fluid dispensing system of claim 1, wherein the drive motor is attached to the mating surface and the driveshaft extends through an aperture in the mating surface such that, when the docking station receives the fluid outlet, the driveshaft is inserted into the driveshaft aperture of the fluid pump with the fluid pump positioned on one side of the mating surface and the drive motor positioned on an opposite side of the mating surface.

3. The fluid dispensing system of claim 1, wherein the receiving surface defines a guide channel that is configured to receive at least a portion of the flange and align the flange in a direction substantially parallel to the flexible fluid reservoir.

4. The fluid dispensing system of claim 3, wherein the flange defines a first flange and further comprising a second flange arranged parallel to and spaced from the first flange so as to define a channel between the first flange and the second flange, and wherein the guide channel of the receiving surface defines a rib adjacent the guide channel such that, when the docking station receives the fluid outlet, the second flange is positioned within the guide channel and the rib is positioned in the channel defined between the first flange and the second flange.

5. The fluid dispensing system of claim 1, wherein the receiving surface of the docking station comprises a first receiving surface and further comprising a second receiving surface positioned parallel to and spaced apart from the first receiving surface such that, when the docking station receives the fluid outlet, the flange is received between the first receiving surface and the second receiving surface.

6. The fluid dispensing system of claim 3, wherein the flange defines a guide surface configured to be inserted into the guide channel of the docking station, and the guide surface is configured to rotationally align the flange about an axis extending through a center of the fluid dispensing aperture.

7. The fluid dispensing system of claim 6, wherein the flange is substantially circular and the guide surface is a chamfered edge of the substantially circular flange.

8. The fluid dispensing system of claim 1, wherein the flexible fluid reservoir comprises a bag positioned within a box, and the fluid outlet extends from an exterior surface of the box.

9. A docking station comprising:

a receiving surface configured to receive a flange extending about at least a portion of a fluid dispensing aperture defined by a fluid outlet connected to a flexible fluid reservoir;

a mating surface extending substantially orthogonally from the receiving surface, the mating surface being configured to mate with a drive motor that includes a driveshaft for driving a fluid pump connected to the fluid outlet;

an outlet surface extending substantially orthogonally from the receiving surface and substantially orthogonally from the mating surface, the outlet surface being configured to support the fluid outlet; and a locking member that defines an inlet nozzle and outlet nozzle, wherein the inlet nozzle is configured to be inserted into the fluid outlet and the locking member is configured to releasably lock to the outlet surface so as to mechanically affix the fluid outlet to the outlet surface.

10. The docking station of claim 9, wherein the mating surface is configured to mate with the drive motor such that, when the receiving surface receives the flange extending about at least a portion of the fluid dispensing aperture, the driveshaft is inserted into a driveshaft aperture defined by the fluid pump with the fluid pump positioned on one side of the mating surface and the drive motor positioned on an opposite side of the mating surface.

11. The docking station of claim 9, wherein the receiving surface defines a guide channel that is configured to receive at least a portion of the flange and align the flange in a direction substantially parallel to the flexible fluid reservoir.

12. The docking station of claim 11, wherein the flange defines a first flange and further comprising a second flange arranged parallel to and spaced from the first flange so as to define a channel between the first flange and the second flange, and wherein the guide channel of the receiving surface defines a rib adjacent the guide channel such that, when the receiving surface receives the flange, the second flange is positioned within the guide channel and the rib is positioned in the channel defined between the first flange and the second flange.

13. The docking station of claim 9, wherein the receiving surface of the docking station comprises a first receiving surface and further comprising a second receiving surface positioned parallel to and spaced apart from the first receiving surface such that, when the receiving surface receives the flange, the flange is received between the first receiving surface and the second receiving surface.

14. The docking station of claim 9, wherein the receiving surface is configured to receive a substantially circular flange that defines a guide surface, and the guide surface is a chamfered edge of the substantially circular flange.

15. A fluid dispensing system comprising:

means for storing fluid;

a fluid outlet connected to the means for storing fluid, the fluid outlet defining a fluid dispensing aperture and a flange extending about at least a portion of the fluid dispensing aperture;

means for mechanically conveying fluid out of the means for storing fluid, the means for mechanically conveying fluid being connected to the fluid outlet;

means for driving the means for mechanically conveying fluid;

means for receiving the fluid outlet and aligning the fluid outlet so that the means for mechanically conveying fluid are aligned with the means for driving, wherein the means for receiving the fluid outlet comprises a receiving surface configured to receive the flange, a mating surface extending substantially orthogonally from the receiving surface and configured to mate with the drive motor, and an outlet surface extending substantially orthogonally from the receiving surface and substantially orthogonally from the mating surface, the outlet surface being configured to support the fluid outlet; and means for releasably locking the fluid outlet to the means for receiving the fluid outlet and aligning the fluid outlet, the means for releasably locking the fluid outlet comprising an inlet nozzle configured to be inserted into the fluid outlet and an outlet nozzle.

16. The fluid dispensing system of claim 15, wherein the means for mechanically conveying fluid define a driveshaft aperture, the means for driving include a driveshaft, and the means for receiving the fluid outlet and aligning the fluid outlet comprise means for receiving the fluid outlet and aligning the fluid outlet so the driveshaft aperture is coaxially aligned with the driveshaft.

* * * * *